US005320770A

United States Patent [19]

Conway et al.

[11] Patent Number: 5,320,770

[45] Date of Patent: Jun. 14, 1994

[54] ELECTRORHEOLOGICAL (ER) FLUID BASED ON AMINO ACID CONTAINING METAL POLYOXO-SALTS

[75] Inventors: Lori J. Conway, Hope; Donald A. Kadlec, Midland; Joan S. Holtschlag, Saginaw, all of Mich.

[73] Assignee: Dow Corning Corporation, Midland, Mich.

[21] Appl. No.: 874,450

[22] Filed: Apr. 27, 1992

[51] Int. Cl.[5] ..... C10M 171/00; C10M 169/04

[52] U.S. Cl. ..... 252/75; 252/74; 252/572; 556/28; 556/55; 556/56; 556/131; 556/134; 556/147; 556/148; 556/179; 556/183

[58] Field of Search ..... 252/75, 74, 572; 556/183, 179, 55, 56, 28, 147, 148, 131, 134

[56] References Cited

U.S. PATENT DOCUMENTS

| | | | |
|---|---|---|---|
| 4,017,599 | 4/1977 | Rubino | 556/183 |
| 4,612,130 | 9/1986 | Landry et al. | 556/183 |
| 4,702,855 | 10/1987 | Goossens | 252/75 |
| 4,994,198 | 2/1991 | Chung | 252/78.3 |
| 5,156,834 | 10/1992 | Beckmeyer et al. | 424/47 |

FOREIGN PATENT DOCUMENTS

| | | |
|---|---|---|
| 1-172496 | 7/1989 | Japan . |
| 1-304188 | 12/1989 | Japan . |
| 3-166295 | 7/1991 | Japan . |
| 3-200897 | 9/1991 | Japan . |
| 1570234 | 6/1980 | United Kingdom . |

*Primary Examiner*—Christine Skane

*Attorney, Agent, or Firm*—Timothy J. Troy; Robert L. McKellar

[57] ABSTRACT

The present invention relates to an electrorheological fluid composition comprising a dispersion of a plurality of solid particles in an electrically non-conducting liquid, the improvement comprising using as said solid particles a composition having the general formula:

$$[(M)^p(H_2O)_x(OH)_y]^q{}_c[A]^r{}_d \cdot B_z \cdot nH_2O$$

wherein M is a metal cation or a mixture of metal cations at various ratios; p is the total valence of M and has a value of greater than zero; x is zero or has a value greater than zero, y is zero or has a value greater than zero, with the proviso that only one of x or y can be zero at any given time; q has a value of p minus y with the proviso that q has a value of at least one; c has a value of greater than zero; A is an anion or a mixture of anions at various ratios; r is the total valence of A with the proviso that r has a value of at least one; d has a value of greater than zero with the proviso that ($q \times c$) is always equal to ($r \times d$); B is an amino acid or a mixture of amino acids; z has a value of from 0.01 to 100; and n is a number from 0 to 15. The ER fluids of the present invention have greatly improved yield stress increasing potential stress transfer characteristics, and good dispersion stability.

11 Claims, No Drawings

ELECTRORHEOLOGICAL (ER) FLUID BASED ON AMINO ACID CONTAINING METAL POLYOXO-SALTS

BACKGROUND OF THE INVENTION

The present invention relates to an electrorheological fluid comprising a dispersed phase and a base liquid wherein the dispersion consists of finely divided particles of a metal amino acid salt.

Electrorheological (ER) fluids are composed of a polarizable solid phase dispersed in a dielectric fluid phase. ER fluids are unique in that they have the ability to change their characteristics from liquid-like to solid-like upon application of an external voltage. This change is reversible which means that the liquid-like state returns upon removal of the electric field. Upon application of a voltage, the solid particles form fibril-like networks which bridge the electrode gap. At this point, the material will not behave as a Newtonian fluid, but will exhibit a Bingham plastic behavior. Fluids exhibiting the Bingham plastic effect require application of a particular level of force (yield stress) before the material will flow again.

It is desirable in the ER fluid art to improve the strength of such fluids which thereby permits smaller devices requiring less power drive to be built. The production of an ER fluid with greater strength would also allow devices to be operated at lower voltages, which would have advantages in power supply design, and generally would open up other application areas for the use of ER fluids that are currently beyond the capabilities of existing ER fluids. It is also desirable in an electrorheological fluid to match the density of the solid phase with the density of the fluid phase.

Aluminum based particle systems have been described in the art. For example, Goosens et al., in U.S. Pat. No. 4,702,855, discloses ER fluids based on aluminum silicates in an electrically non-conducting liquid and a suitable dispersing agent. The contribution to the art provided by this patent was an improved electroreactivity, as well as improved stability over a wide temperature range. This was accomplished by the addition of certain polysiloxane dispersants to the ER fluid formulations.

There also have been several ER particle systems which have described that either colloidal aluminum or colloidal zirconia or a mixture thereof could be utilized in the disperse phase of an ER fluid. For example, Hashimoto et al., Japanese Patent Application Laid Open 01304188, discloses an electroviscous fluid which consists of 5 to 50 weight percent of a dispersion of particles of 5 to 1000 microns in diameter and 95 to 50 weight percent of a liquid phase of a nonreactive or modified silicone oil having a 0.90 to 1.30 specific gravity. The particles can be one or a mixture of more than one of colloidal silica, colloidal alumina, colloidal zirconia, or antimony oxide.

Japanese Patent Application Laid Open No. 01172496 teaches an electroviscous fluid obtained by dispersing dielectric particles into an oily medium high in electrical insulation, the dielectric particles comprise hollow bodies into which the oily medium will not permeate. Examples of the dielectric particles are the metallic oxides of silica, alumina, silica-alumina, spinel, zirconia, and titanium oxide or vanadium oxide; metals such as aluminum, silicon, nickel or copper; ferroelectric substances such as calcium titanate or strontium titanate; or of a synthetic high polymer such as polyvinylidene fluoride, polyamide or an ion exchange resin. The fluid is disclosed as having long-term stability.

Japanese Patent Application Laid Open No. 03166295 teaches an electroviscous fluid having improved dispersibility comprising dielectric particles dispersed in an electrically insulating liquid which has main particles having a grain size of 3–100 microns and contains finer particles having an average grain size of 0.3 micron to 20% of the average grain size of the main particles. Available materials for the finer particles include polyamides, MgO, Zr oxide, silica, alumina, Ti oxide, and Si nitride. Available materials for main dielectric particles include starch, cellulose, casein, ion exchange resins, silica, alumina, silica-alumina, $Al_2$-,$(OH)_3$, $Zn(OH)_2$, mica, and lithium and potassium tartrate.

Japanese Patent Application Laid Open No. 03200897 discloses a new fluid composition which consists of one or a mixture of inorganic ion-exchanged materials comprising hydroxides of polyvalent metals, acidic salts of polyvalent metals, and potassium titanates dispersed in an electrically insulating dipersion medium. Preferred polyvalent metal hydroxides include titanium, zirconium, and magnesium hydroxide. Acidic salts of polyvalent metals include zirconium phosphate and titanium arsenate.

Other particle systems which have been described in the ER fluid art recently are silicone amine sulfate particles dispersed in polydimethylsiloxane fluid as described in U.S. Pat. No. 4,994,198, and lithium-polymethylmethacrylate particles dispersed in a chlorinated paraffin base fluid as described in Great Britain Unexamined Application No. 1570234.

However none of the references described hereinabove teach a hydrolyzable metal amino acid salt which produces an electrorheological fluid having unexpectedly high yield stress values while retaining good dispersion stability in compatible base liquids.

SUMMARY OF THE INVENTION

The present invention is an electrorheological fluid which provides high yield stress values which increase potential stress transfer characteristics. It has now been discovered that certain amino acid salts may be dispersed in an electrically non-conducting liquid to form fluid compositions which exhibit the electrorheological effect. These compositions offer distinct advantages over prior art systems since they provide greatly improved yield stress values while maintaining good dispersion stability in compatible base liquids.

It is an object of this invention to provide an electrorheological fluid which provides high yield stress values. It is also an object of this invention to provide an electrorheological fluid which maintains good dispersion stability in compatible base fluids. It is an additional object of this invention to provide an ER fluid which allows devices to be operated at lower voltages.

These and other features, objects and advantages of the present invention will be apparent upon consideration of the following detailed description of the invention.

DETAILED DESCRIPTION OF THE INVENTION

The present invention relates to an electrorheological fluid composition comprising a dispersion of a plurality of solid particles in an electrically non-conducting liquid, the improvement comprising using as said solid particles a composition having the general formula:

$$[(M)^p(H_2O)_x(OH)_y]^q{}_c[A]^r{}_d \cdot B_z \cdot nH_2O \quad (I)$$

wherein M is a metal cation or a mixture of metal cations at various ratios; p is the total valence of M and has a value of greater than zero; x is zero or has a value greater than zero, y is zero or has a value greater than zero, with the proviso that only one of x or y can be zero at any given time; q has a value of p minus y with the proviso that q has a value of at least one; c has a value of greater than zero; A is an anion or a mixture of anions at various ratios; r is the total valence of A with the proviso that r has a value of at least one; d has a value of greater than zero with the proviso that $(q \times c)$ is always equal to $(r \times d)$; B is an amino acid or a mixture of amino acids; z has a value of from 0.01 to 100; and n is a number from 0 to 15.

Herein the term "hydrolyzed" as applied to the compositions of the present invention generally denotes a composition which has been subjected to hydrolysis. Hydrolysis is a chemical reaction in which water reacts with another substance to form one or more new substances. This involves the ionization of the water molecule as well as breaking the chemical bonds of the compound hydrolyzed. A compound which can be subjected to hydrolysis is hydrolyzable.

M in formula (I) described hereinabove is a metal cation or a mixture of metal cations at various ratios. Preferred metal cations for the compositions of the present invention are the alkaline earth metals, transition metals, lanthanides, Group 13 elements, Group 14 elements, and Group 15 elements (the Group 13, 14, and 15 elements are named according to the new IUPAC nomenclature). Especially preferred metal cations for purposes of the present invention are aluminum, zirconium, beryllium, magnesium, boron, gallium, indium, thallium, silicon, germanium, tin, lead, arsenic, antimony, bismuth, tellurium, scandium, yttrium, actinium, titanium, hafnium, thorium, niobium, tantalam, chromium, iron, ruthenium, cobalt, copper, zinc, cadmium, and the lanthanides or mixtures thereof. In a preferred embodiment of the present invention the metal cation M is a metal cation or a mixture of metal cations selected from the group consisting of aluminum, zirconium, iron, and zinc.

M in formula (I) described hereinabove can be a mixture of metal cations at various ratios. Therefore M can be described by the formula $M^p = M^{p1}{}_a M^{p2}{}_b M^{p3}{}_c \ldots$ wherein a, b, and c are the number of cations present in the composition, and p is the summation of charges on the metal cations (i.e. p is the overall charge on M) where more than one metal cation is employed. Thus, for example, if the compositions of the present invention have the formula $[(Al_4Zr_1)(OH)_{12}]Cl_4$ (glycine).3.3 $H_2O$, p would be equal to 16 (i.e. Al has a charge of +3, Zr has a charge of +4, so $4(+3)+1(+4)=16$), (i.e. $p = a \times p1 + b \times p2 + c \times p3$).

The amount of M to be used in the compositions of the present invention is not critical and can be any amount that will increase the yield stress of the electrorheological fluid compositions of the invention. No specific amount of metal cation can be suggested to obtain a specified yield stress since the desired amount of any particular metal cation to be used will depend upon the concentration, type, and number of amino acids, the nature, amounts, and number of anions selected, the amount of water present, and the presence or absence of optional ingredients.

In the electrorheological fluid compositions of this invention the amount of metal cation M can typically be as low as 5% by weight of the total composition to provide an electrorheological effect. A practical upper limit appears to be about 90% by weight of the total composition. Greater amounts of metal cation can be used if desired however a decrease in the electrorheological effect may result. We have generally taught the broad and narrow limits for the metal cation component concentration for the process of this invention, however, one skilled in the art can readily determine the optimum level for each application as desired.

A in formula (I) described hereinabove is an anion or a mixture of anions at various ratios. Monovalent, divalent, and trivalent anions or mixtures thereof all effectively increase the performance of the electrorheological fluids of the present invention. In a preferred embodiment of the present invention the anion is a halide. Especially preferred as an anion in the electrorheological fluid compositions of the present invention is an anion or mixture of anions selected from the group consisting of chloride, bromide, iodide, sulfate, and phosphate.

A in formula (I) described hereinabove can be a mixture of anions at various ratios. Therefore A can be described by the formula $A^r = A^{r1}{}_a A^{r2}{}_b A^{r3}{}_c \ldots$ wherein a, b, and c are the number of anions present in the composition, and r is the summation of charges on the anions (i.e. r is the overall charge on A) where more than one anion is employed. Thus, for example, if the compositions of the present invention have the formula $[(Al_6)(OH)_{10}](SO_4)_2Cl_4$(glycine). 3.3 $H_2O$, r would be equal to ($SO_4$ has a −2 charge, and Cl has a −1 charge) $2(-2)+4(-1)=-8$ (i.e. $r = a \times r1 + b \times r2 + c \times r3$, etc.).

The amount of A to be used in the compositions of the present invention is not critical and can be any amount that will increase the yield stress of the electrorheological fluid compositions of the invention. No specific amount of anion can be suggested to obtain a specified yield stress since the desired amount of any particular anion to be used will depend upon the concentration, type, and number of amino acids, the nature, amounts, and number of metal cations selected, and the presence or absence of optional ingredients. The amount of A in the compositions of this invention is normally predetermined by the requirements of electrical neutrality with the cationic component of the composition.

In the electrorheological fluid compositions of this invention the amount of anion A can typically be as low as 1% by weight of the total composition to provide an electrorheological effect. A practical upper limit appears to be about 90% by weight of the total composition. Greater amounts of an anion can be used if desired however a decrease in the electrorheological effect may result. We have generally taught the broad and narrow limits for the anion component concentration for the compositions of this invention, however, one skilled in the art can readily determine the optimum level for each application as desired.

B in formula (I) described hereinabove is an amino acid or a mixture of amino acids. This component is critical to the compositions of the present invention in terms of yield stress performance and electrorheological fluid performance. Amino acids are well known as the building blocks of proteins. Amino acids are amphoteric, which means that amino acids exist in aqueous solution as dipolar ions. An amino acid for the purposes of the present invention is an organic acid containing both a basic amino group ($NH_2$) and an acidic carboxyl group (COOH). According to the present invention the amino acid can be selected from the group consisting of essential amino acids, nonessential amino acids, and synthetic amino acids or mixtures thereof. Essential and nonessential amino acids are those amino acids which occur in the free state in plant and animal tissue or are alpha-amino acids which have been established as protein constituents. Examples of essential amino acids which are within the scope of the present invention include isoleucine, phenylalanine, leucine, lysine, methionine, threonine, tryptophan, and valine or mixtures thereof. Examples of non-essential amino acids which are within the scope of the present invention include alanine, glycine, arginine, histidine, proline, and glutamic acid or mixtures thereof. Synthetic amino acids include all amino acids that are synthesized by various methods such as by the fermentation of glucose. Examples of synthetic amino acids which are preferred for the present invention include Sarcosine, 6-aminocaproic Acid, DL-2-Aminobutryic Acid or mixtures thereof.

The amino acid ingredient unexpectedly produces a greatly improved yield stress performance in comparison to those electrorheological fluid compositions which do not contain an amino acid component. All known amino acids provide increased electrorheological performance when employed in the compositions of the present invention. Especially preferred as amino acids in the electrorheological fluid compositions of the present invention are glycine, proline, phenylalanine, and arginine or mixtures thereof.

The amount of B to be used in the compositions of the present invention is not critical and can be any amount that will increase the yield stress of the electrorheological fluid compositions of the invention. No specific amount of amino acid can be suggested to obtain a specified yield stress since the desired amount of any particular amino acid to be used will depend upon the concentration, type, and number of metal cations, the nature and amounts of the anion employed, the amount of water present, and the presence or absence of optional ingredients. In the electrorheological fluid compositions of this invention the amount of amino acid typically sufficient to provide an increase in the yield stress performance of an electrorheological fluid is about 0.1 mole percent of M. A practical upper limit appears to be 100 mole percent of M. We have generally taught the broad and narrow limits for the amino acid component concentration for the compositions of this invention, however, one skilled in the art can readily determine the optimum level for each application as desired.

The ligand of the present invention is not limited to an amino acid. Other ligands may also be present which will produce the desired electrorheological effect. Examples of ligands which will produce an advantageous effect include mono-, di-, or polycarboxylates; primary, secondary, and tertiary amines; amides; sulfur containing compositions; phosphorous containing compositions; arsenic containing compositions; selenium containing compositions; oxygen and hydroxyl containing compositions such as alcohols, diols, polyols, diketones, etc.; and multidentate compositions such as crown ethers and cryptates.

Also the compositions of the present invention contain water and water forms the remainder of the composition. Water is generally present in the electrorheological fluids of the present invention at a level of from about 0.1% to about 25% by weight of the total composition.

In formula (I) shown hereinabove, x and y are equal to the coordination number of M. Thus if more than one metal cation is selected for the composition, then x and y would be equal to the sum of the coordination numbers of the metal cations selected. Also one of x and y can be zero. Thus if y=0, then the compositions of this invention have the formula:

$$[M^p(H_2O)_x]^q{}_c[A]^r{}_d.[B]_z.nH_2O \quad \text{(II)}$$

wherein M is as defined above in (I); p is equal to q; x is equal to the coordination number of M; and wherein c,r,d,z, and n are as defined in formula (I) described hereinabove. If x=0, then the compositions of the invention have the formula:

$$[M^p(OH)_y]^q{}_c[A]^r{}_d.[B]_z.nH_2O \quad \text{(III)}$$

wherein M and p are as defined above in (I); y is equal to the coordination number of M; and wherein q,c,r,d,n, and z are as defined in formula (I) described hereinabove. In essence formula III described hereinabove becomes equivalent to the hydroxide of the metal, or the hydroxides of the mixed metals which constitute the upper limit of the compositions of the present invention. In formula (III) described hereinabove, the Anion (A), Amino Acid (B), and water are only present in trace amounts.

In the formulas described hereinabove, p and q (q=0 only in the case of hydroxides) are positive numbers. In formula (I), q=p−y at all times. The lower limit of q in the formulas above is zero. Also in the formulas described hereinabove, x and y are not necessarily integers but can also be fractions. For the preferred metals of this invention, the coordination numbers are typically 3, 4, 5, 6, 8, and 12. For the especially preferred metals of the present invention, the coordination number is typically 4 and 6.

In a preferred embodiment of the present invention the electrorheological fluid composition comprises a dispersion of a plurality of solid particles in an electrically non-conducting liquid, wherein the solid composition is a compound having the formula $[(Al_aZr_b)(OH)_y][(A)]_d(B)_z.nH_2O$ wherein y is a number from 0.1 to 15, A is chloride, d is a number from 0.1 to 15, B is proline, z is a number from 0.1 to 5, and n is a number of from 0.1 to 10 and wherein (a+b) is from 1 to 10.

The solid compositions of the present invention are made from hydrolyzable simple metal salts in the presence of compounds that can serve as coordination ligands with the metal cations. The hydrolyzable metal salts can be prepared with a variety of methods. The simplest salts are commercially available. One method involves the oxidation of pure metal using an oxidizing agent, preferably a strong protonic acid, or an acid salt of the cation. Hydrolyzable metal salts produced in that manner are those that are composed of metal cations with standard reduction potentials below zero (versus standard hydrogen electrode). That includes common metals like Fe, Zn, Al, Cr, etc. Common oxidizing agents for these reactions are HCl, HBr, $HNO_3$, $H_2SO_4$, or soluble acid salts of these cations (i.e. $AlCl_3.6H_2O$, $AlBr_3.6H_2O$, etc.). Since the metals used are hydrolyzable, the reduction of $H+$ to $H_2$ gas that occurs during the reaction increases the pH of the solution. By controlling the stoichiometry of the reaction one skilled in the art can control the degree of hydrolysis and consequently the composition of the final material (i.e. the x and y coefficients in Formula I described hereinabove). The introduction of the ligand can be done before or after or during the oxidation/hydrolysis steps of the metal cation.

Another method for preparation of the solid compositions of the present invention involves neutralization of a metal salt or a mixture of metal salts with a base. Common examples of bases that can be used are soluble metal hydroxides, $NH_3$, metal carbonates, water soluble amines, etc. As described hereinabove, the control of the stoichiometry of the reagents determines the degree of neutralization of the final composition. Salts of all metals and metalloids of the present invention can be partially or completely neutralized with these or similar bases. The presence of the coordination ligand can be added at various stages of the process. However the composition will most likely vary depending on the method used to add the ligand, and the time of the addition of the ligand. In other words the presence of the ligand affects the neutralization reaction. Some examples of reactions include $AlCl_3+NaOH$, $ZnCl_2+NH_3$, $CoCl_2+Na_2CO_3$, $BeCl_2+CH_3NH_2$.

Another method for preparation of the solid compositions of the present invention is almost identical to the method described immediately above except that one uses a basic metal salt that is acidified to a specified degree with an acid. The reaction can be carried out in the presence or absence of a ligand. Some examples are: $NaAlO_2+HCl$, $ZrO_2CO_2+HCl$, $Fe(OH)_2,+HNO_3$, $Co(OH)_2+CH_3COOH$. It should also be noted that the more insoluble metal oxides and hydroxides may be difficult to acidify.

A final method for the synthesis of the solid compositions of the present invention involves the hydrolysis of metal alkoxides, $M(OR)_r$, or metal siliconates, $M(OSiR_3)_r$. This is accomplished by adding a predetermined amount of water to a solution of the metal alkoxide or siliconate in an organic or silicone solvent. The stoichiometry of the reagents again determines the degree of hydrolysis of the metal cations as in the methods described hereinabove. The addition of the ligand at various stages of the reaction will produce variations in the compositions. One skilled in the art will be able to determine those differences through routine experimentation. Some common examples of starting materials for these type of hydrolysis reactions are $[CH_3CH_2O]_4Zr$, $[(CH_3)_3CO]_4Ti$, $(CH_3CH_2O)_3Al$, etc.

There are several methods by which the solids can be isolated from solution after the synthesis of the compositions (i.e. the synthesis methods were described hereinabove). Most of the methods of synthesis of the solid particles described hereinabove produce water soluble materials. The most common methods of isolating the solid particles from solution are spray drying, oven drying, precipitation via slow evaporation or cooling, freeze thaw, or addition of another solvent (i.e. organic solvent) to reduce the solubility. When the precipitation, freeze thaw, and solvent addition methods are used they need to be followed by filtration and drying steps. The oven drying, precipitation, and solvent addition methods contain a risk, that is because these methods are slower and many of the solid particle compositions described herein are metastable, and solids which do not necessarily correspond to the initial composition in solution may be obtained.

The ER fluids of the present invention can be utilized for many applications such as vehicle transmissions, fan clutches and accessory drives, engine mounting systems, acoustical damping, tension control devices, controlled torque drives.

ER fluids based on the above described metal amino acid salts may be prepared by uniformly dispersing a plurality of the solid amino acid salt particles in an electrically non-conducting liquid. The electrically non-conducting liquid may be selected from any of the known liquid vehicles (i.e. the continuous medium) used to prepare current art ER fluids. Thus, for example, it may be an organic oil, such as mineral oil, a polychlorinated biphenyl, castor oil, a fluorocarbon oil, linseed oil, CTFE(chlorotrifluoroethylene) and the like. The electrically non-conducting liquid may alternatively be a silicone oil, such as polydimethylsiloxane, polymethyltrifluoropropylsiloxane, a polymethylalkylsiloxane, polyphenylmethylsiloxane, and the like. The liquids used as the electrically non-conducting liquid preferably have a viscosity of about 1 to about 10,000 cP at 25° C. It is highly preferred that the electrically non-conducting liquid is chlorotrifluoroethylene having a viscosity at 25° C. of about 4 to 1,000 cP at 25° C. Typically, from about 95 to about 25 weight percent of the electrically non-conducting liquid is present in the electrorheological fluid compositions of the present invention. However it is preferable that about 80 to about 60 weight percent of the electrically non-conducting liquid is present in the electrorheological fluid compositions of the present invention. The optimum amount that is used depends greatly on the specific amino acid salt, liquid type, liquid viscosity, and intended application, among other variables.

Dispersion of the solid amino acid salt in the electrically non-conducting liquid is preferably accomplished by any of the commonly accepted methods, such as those employing a ball mill, paint mill, high shear mixer, spray drying or hand mixing. During this dispersion process, the amino acid salt particles and the electrically non-conducting liquid are sheared at a high rate, thereby reducing the size of the particles to a point where they form a stable suspension in the liquid medium. It has been found that a final particle size having an average diameter of about 5 to 100 micrometers is preferred. If the diameter is above this range, the particles tend to settle out, while if the diameter is too low, thermal Brownian motion of the particles tends to reduce the ER effect.

An equivalent dispersion of the amino acid salt in the electrically non-conducting liquid may also be affected by first grinding the particles to a suitable fineness and subsequently mixing in the liquid component.

Typically, from about 5 to about 75 weight percent of the amino acid salt is dispersed in the electrically non-conducting liquid. However, the optimum amount that is used depends greatly on the specific amino acid salt, liquid type, liquid viscosity, and intended application, among other variables. Those skilled in the art will readily determine the proper proportions in any given system by routine experimentation.

The ER fluid compositions of the present invention may further comprise antioxidants, stabilizers, colorants, and dyes.

Electrorheological fluids of this invention find utility in many of the applications now being serviced by current art ER fluid compositions. Examples of this diverse utility include torque transfer applications such as traction drives, automotive transmissions, and anti-lock brake systems; mechanical damping applications such as active engine mounts, shock absorbers, and suspension systems; and applications where controlled stiffening of a soft member is desired such as hydraulic valves having no moving parts and robotic arms. The compositions of the present invention find particlular utility in applications requiring an ER fluid which supplies high yield stress values while maintaining good dispersion stability in the base fluid.

The compositions of the present invention were tested for Yield Stress and Current Density in comparison to ER fluids not having an amino acid component. A Rheometrics RSR rheometer is used for measuring the yield stress. The rheometer motor applies a torque to the upper test fixture which results in a shear stress being applied to the sample. The amount of stress is a function of the test fixture and the torque. Parallel plates are employed for ER fluid yield stress testing. The plate diameters range from 8 millimeters (mm) to 50 mm. The strain in the material is a function of the sample geometry and the rotation of the upper parallel plate. From the stress applied and the resulting strain, a stress/strain curve is plotted to determine the yield stress, which is the point where a small increase in stress results in a large increase in strain.

The application of an electric field to the instrument test fixture required modifications of the rheometer. An adaptor was made from a high dielectric strength phenolic resin and placed between the motor coupling and upper test fixture. A new base was made of the same phenolic resin. The lower test fixture was readily equipped with an electrical lead due to its fixed position. The upper electrode required a brush type connection with very low friction. This was accomplished with copper foil attached to a piece of high voltage wire.

The current density of the samples was also tested. During any mechanical test the current is monitored using a picoammeter which is in series with the power supply located between the test sample and the earth ground.

The average formula for the compositions of the present invention shown hereinbelow was determined as follows. The amount of Anion in the compositions of the present invention was determined by Potentiometric Titration. A sample is weighed into a beaker and stirred. Electrodes are located in the sample, out of the stirring vortex, and not touching the sides of the beaker. The titrant runs from the burette directly into the sample solution. The endpoint of the titration is determined by a change in the millivolt reading. The millivolt reading will increase (negatively with an Ag/AgCl glass electrode, positively with a Calomel glass electrode) by larger amounts as the endpoint is approached, the amount of increase will fall off sharply after the endpoint is passed. The highest change in millivolt/milliliter will be the endpoint.

The metallic elements in the compositions of the present invention were determined by the Plasma Emission Spectroscopy—Acid Ashing Technique. The sample is destroyed by acid digestion under oxidizing conditions to convert the metallic elements to the ionic state. Silicon dioxide is removed by treatment with Hydrofluoric Acid. The water-soluble metallic elements are quantitatively determined over a range of parts per million to percent by plasma-emission spectrometry. Sample solutions are aspirated into an argon plasma and the characteristic emitted light intensity is measured for specific elements. The standard computer generated data is translated from light intensity to concentration of the specified elements. Standard solutions of the specified elements are used to calibrate the instrument with each series of samples.

The carbon, hydrogen, and nitrogen content of the compositions of the present invention for the purposes of determining the average formula of the samples described hereinbelow was determined by catalytic oxidation of the sample. Carbon and hydrogen are measured as carbon dioxide and water. Nitrogen is measured in the elemental form. A variety of automatic or semi-automatic analyzers are available. Gases are separated prior to detection by adsorption/desorption on specific substrates. Various detection systems are used, including manometric, gravimetric, thermal conductimetric, and infrared. Carbon, hydrogen, and/or nitrogen are reported as a percentage of the total sample.

The following amino acids were utilized in the Examples hereinbelow:

Proline = $C_4H_7NHCOOH$
Glycine = $NH_2CH_2COOH$
Phenylalanine = $C_6H_5CH_2CH(NH_2)COOH$
Arginine = $H_2NC(NH)NH(CH_2)_3CH(NH_2)COOH$
Glutamic Acid = $COOH(CH_2)_2CH(NH_2)COOH$ The following synthetic amino acids were utilized in the Examples hereinbelow:

Sarcosine = $CH_3NHCH_2CO_2H$
6-aminocaproic Acid = $H_2N(CH_2)_5CO_2H$
DL-2-Aminobutryic Acid = $C_2H_5CH(NH_2)CO_2H$ The following compositions were also tested for an Electrorheological effect:

Oxalic Acid: $(COOH)_2.2H_2O$
Aminofunctional Silicone Hydrolyzate: $(CH_3RSiO)_x$
wherein R = $—CH_2CH(CH_3)CH_2NH(CH_2)_2NH_2$ and wherein x = 2 to 6.

EXAMPLE I

In order to illustrate the advantages of the ER fluids of the present invention over those previously described in the art the following tests were run. All parts and percentages in the examples are on a weight basis, unless indicated to the contrary.

Aluminum Zirconium Proline chlorohydrate was prepared according to the following procedure: 370.05 g of zirconium carbonate paste ($ZrO_2,CO_2$. $nH_2O$), 180.91 g of concentrated Hydrochloric Acid (HCl), and 185.13 g (DI) Deionized water were mixed and allowed to react. After the reaction was complete, 90 g of proline was added. The resulting solution was then added to a mixture of 48.89 g of aluminum chloride (50% aqueous), 880 g of aluminum chlorohydrate ($Al_2(OH)_5Cl$) (50% aqueous), and 26.36 g DI water. Additional DI water was added in order to keep all reactants and products soluble.

The AZP (Aluminum Zirconium Proline chlorohydrate) particles were dispersed by manual hand mixing at weight percent loadings ranging from 25 to 45 wt % (weight percent) in 20 Centistoke polydimethylsiloxane fluid, chlorotrifluoroethylene (CTFE) fluid, and chlorinated parrafin fluid at ambient temperatures. Yield stress values were measured on a Rheometrics Stress Rheometer using parallel plate configuration and a 1 mm gap. Yield stress values were measured in the presence of electric fields at 0, 1, and 2 kV/mm and the results are reported in Table I below. Yield stress values of current ER technology were also tested to show the unexpected results achieved by the present invention as compared to those described in the art. The comparative samples tested were silicone amine sulfate (SAS) in 20 centistoke polydimethylsiloxane fluid and in CTFE, and lithium-polymethylmethacrylate (Li-PMMA) particles dispersed in a chlorinated paraffin base fluid which are described in U.S. Pat. No. 4,994,198 and Great Britain patent GB-A-1570234.

TABLE I

| PARTICLES | WT % | BASE FLUID | Yield Stress at: 0kV/mm | 1kV/mm (in Pascals) | 2kV/mm |
|---|---|---|---|---|---|
| SAS | 33 | PDMS | 20 | 460 | 1120 |
| SAS | 22 | CTFE | 64 | 376 | 850–1500 |
| AZP | 35 | PDMS | 25 | 300 | 1388 |
| AZP | 45 | PDMS | 20 | 800 | 2040 |
| AZP | 35 | CTFE | 136 | 2455 | 5364 |
| AZP | 25 | CTFE | 32 | 1336 | 2856 |
| AZP | 35 | CHL. PARAFFIN | 48 | 456 | 504 |
| Li-PMMA | 33 | PDMS | — | — | 1000 |
| Li-PMMA | 27 | PDMS | <10 | 200 | 700 |
| Li-PMMA | 27 | CHL. PARAFFIN | <10 | 650 | 950 |

The ER fluids of the present invention have greatly improved yield stress, increasing potential stress transfer characteristics over those previously described in the art. The ER fluids of the present invention also retain good dispersion stability in CTFE.

EXAMPLE II

The following samples were prepared and tested for Yield Stess and Current Density. The results of the tests are described in Table II shown hereinbelow. The yield stress and current density of the compositions prepared hereinbelow were tested according to the method described hereinabove.

Sample 1

Aluminum Zirconium Glycine chlorohydrate was prepared according to the following procedure: 370.05 g of zirconium carbonate paste ($ZrO_2CO_2 \cdot nH_2O$), 180.91 g of concentrated Hydrochloric Acid (HCl), and 185.13 g DI water were mixed and allowed to react. After the reaction was complete, 90 g of glycine was added. The resulting solution was then added to a mixture of 48.83 g of aluminum chloride (50% aqueous), 880.62 g of aluminum chlorohydrate ($Al_2(OH)_5Cl$) (50% aqueous), and 26.16 g DI water. Additional DI water was added in order to keep all reactants and products soluble.

The composition prepared in this sample was a mixture of Aluminum Zirconium Glycine chlorohydrate and Sodium Sulfate and was prepared in the following manner: 10.0 g(grams) of AZG(Aluminum Zirconium Glycine chlorohydrate) was dissolved in deionized (DI) water. 4.41 g of sodium sulfate ($Na_2SO_4$) was dissolved in DI water and then added to the AZG aqueous solution. A precipitate formed in which the chloride ions in the AZG molecule were replaced by sulfate ions (AZG sulfate). The precipitate was filtered, washed with DI water, filtered again, and dried in a forced air oven at about 101° C. The AZG sulfate was then dispersed in 20 cs(centistoke) polydimethylsiloxane (PDMS) at 67 wt % (weight percent) and in chlorotrifluoroethylene (CTFE) at 49 wt %. Yield stress and current density results can be seen in Table II below. The compound of this sample has the average formula:

$$Al_{2.74}Zr(OH)_{7.72}(SO_4)_{2.25}(glycine)_{0.54} \cdot nH_2O$$

Sample 2

The composition prepared in this sample was a mixture of Aluminum Zirconium Froline chlorohydrate and Sodium Sulfate and was prepared in the following manner: 10.0 g of AZP (Aluminum Zirconium Proline chlorohydrate) was dissolved in deionized (DI) water. 4.9 g of sodium sulfate ($Na_2SO_4$) was dissolved in DI water and then added to the AZP aqueous solution. A precipitate formed in which the chloride ions in the AZP molecule were replaced by sulfate ions (AZP sulfate) The precipitate was filtered, washed with DI water, filtered again, and dried in a forced air oven at about 101° C. The AZP sulfate was then dispersed in 20 cs(centistoke) polydimethylsiloxane (PDMS) at 67 wt % and in chlorotrifluoroethylene (CTFE) at 49 wt %. Yield stress and current density results can be seen in Table II below. The compound of this sample has the average formula:

$$Al_{2.74}Zr(OH)_{7.72}(SO_4)_{2.25}(proline)_{0.38} \cdot nH_2O$$

Sample 3

The composition prepared in this sample was a mixture of Aluminum Zirconium Glycine chlorohydrate and Sodium Phosphate and was prepared in the following manner: 10.0 g of AZG was dissolved in deionized (DI) water. Then 3.46 g of sodium phosphate ($Na_3PO_4$) was dissolved in DI water and then added to the AZG aqueous solution. A precipitate formed in which the chloride ions in the AZG molecule were replaced by phosphate ions (AZG phosphate). The precipitate was filtered, washed with DI water, filtered again, and dried in a forced air oven at about 72° C. The AZG phosphate was then dispersed in 20 cs(centistoke) polydimethylsiloxane (PDMS) at 66 wt % (weight percent) and in chlorotrifluoroethylene (CTFE) at 43 wt %. Yield stress and current density results can be seen in Table II below. The compound of this sample has the average formula:

$$Al_{3.45}Zr(OH)_{9.85}(PO_4)_{1.5}(glycine)_{0.26} \cdot nH_2O$$

Sample 4

The composition prepared in this sample was a mixture of Aluminum Zirconium Proline chlorohydrate and Sodium Phosphate and was prepared in the following manner: 10.0 g of AZP was dissolved in deionized (DI) water. Then 3.59 g of sodium phosphate ($Na_3PO_4$) was dissolved in DI water and then added to the AZP aqueous solution. A precipitate formed in which the chloride ions in the AZP molecule were replaced by phosphate ions (AZP phosphate). The precipitate was filtered, washed with DI water, filtered again, and dried in a forced air oven at about 72° C. The AZP phosphate was then dispersed in 20 cs(centistoke) polydimethylsiloxane (PDMS) at 66 wt % (weight percent) and in chlorotrifluoroethylene (CTFE) at 43 wt %. Yield stress and current density results can be seen in Table II below. The compound of this sample has the average formula:

$$Al_{3.56}Zr(OH)_{10.06}(PO_4)_{1.54}(proline)_{0.10}.nH_2O$$

Sample 5

The composition prepared in this sample was Aluminum Zirconium Phenylalanine Chlorohydrate and was prepared in the following manner: 19.82 g of zirconium carbonate paste, 9.69 g of concentrated Hydrochloric Acid (HCl), and 75.74 g DI water were mixed and allowed to react. After the reaction was complete, 10.61 g of phenylalanine (neutral amino acid) was added. The resulting solution was then added to a mixture of 3.13 g of aluminum chloride (50% aqueous), 56.02 g aluminum chlorohydrate ($Al_2(OH)_5Cl$) (50% aqueous), and 1.77 g DI water. Additional DI water was added in order to keep all reactants and products soluble. This sample was then spray dried and dispersed in CTFE at 21 wt %. Yield Stress and current density results can be seen in Table II shown hereinbelow. The compound of this sample has the average formula:

$$Al_4Zr(OH)_{12.28}(Cl)_{3.72}(phenylalanine).nH_2O$$

Sample 6

The composition prepared in this sample was Aluminum Zirconium Arginine Chlorohydrate and was prepared in the following manner: 19.92 g of zirconium carbonate paste, 9.95 g of concentrated Hydrochloric Acid (HCl), and 9.86 g DI water were mixed and allowed to react. After the reaction was complete, 3.93 g of arginine (basic amino acid) was added. The resulting solution was then added to a mixture of 3.17 g of aluminum chloride (50% aqueous), 55.95 g aluminum chlorohydrate ($Al_2(OH)_5Cl$)(50% aqueous), and 1.72 g DI water. Additional DI water was added in order to keep all reactants and products soluble. This sample was then spray dried and dispersed in CTFE at 47 wt %. Yield Stress and current density results can be seen in Table II shown hereinbelow. The compound of this sample has the average formula:

$$Al_4Zr(OH)_{12.15}(cl)_{3.85}(arginine)_{0.34}.nH_2O$$

Sample 7

The composition prepared in this sample was Zirconium Glutamic Acid Chlorohydrate and was prepared in the following manner: 8.15 g of zirconium carbonate paste, 4.01 g of concentrated Hydrochloric Acid (HCl), and 46.49 g DI water were mixed and allowed to react. After the reaction was complete, 1.35 g of glutamic acid (acidic amino acid) was added. The sample then gelled upon mixing. The gel was dried in an oven, ground-/milled and then dispersed in CTFE at 35 wt %. Yield Stress and current density results can be seen in Table II shown hereinbelow. The compound of this sample has the average formula:

$$Zr(OH)_{2.78}(Cl)_{1.22}(glutamic\ acid)_{0.34}.nH_2O$$

TABLE II

| SAMPLE | BASE FLUID | YIELD STRESS AND CURRENT DENSITY 0kV/mm | 1kV/mm | 2kV/mm |
|---|---|---|---|---|
| 1 | PDMS | 88 Pa | 184 Pa | 600–1200 Pa |
| | | 0 uA/cm$^2$ | 0.2 uA/cm$^2$ | 1 uA/c |
| 1 | CTFE | 56 Pa | 96 Pa | 1000–2000 Pa |
| | | 0 uA/cm$^2$ | — | 1 uA/cm$^2$ |
| 2 | PDMS | 96 Pa | 120 Pa | 700 Pa |
| | | 0 uA/cm$^2$ | 0.001 uA/cm$^2$ | 0.02 uA/cm$^2$ |
| 2 | CTFE | 96 Pa | 192 Pa | 650 Pa |
| | | 0 uA/cm$^2$ | 0.002 uA/cm$^2$ | 0.01 uA/cm$^2$ |
| 3 | PDMS | 96 Pa | 1096 Pa | 3500 Pa |
| | | 0 uA/cm$^2$ | 6 uA/cm$^2$ | 44 uA/cm$^2$ |
| 3 | CTFE | 96 Pa | 750 Pa | 2500 Pa |
| | | 0 uA/cm$^2$ | 10 uA/cm$^2$ | 60 uA/cm$^2$ |
| 4 | PDMS | 72 Pa | 900–1500 Pa | 2700–3700 Pa |
| | | 0 uA/cm$^2$ | 3 uA/cm$^2$ | 18 uA/cm$^2$ |
| 4 | CTFE | 96 Pa | 336 Pa | 950 Pa |
| | | 0 uA/cm$^2$ | 1.7 uA/cm$^2$ | 9 uA/cm$^2$ |

TABLE IIA

| SAMPLE | BASE FLUID | YIELD STRESS AND CURRENT DENSITY 0kV/mm | 1kV/mm | 2kV/mm |
|---|---|---|---|---|
| 5 | CTFE | 70 Pa | 360 Pa | 900 Pa |
| | | 0 uA/cm$^2$ | 3 uA/cm$^2$ | 40 uA/cm$^2$ |
| 6 | CTFE | 100 Pa | 1600 Pa | 4000 Pa |
| | | 0 uA/cm$^2$ | 4 uA/cm$^2$ | 16 uA/cm$^2$ |
| 7 | CTFE | 80 Pa | 375 Pa | 880 Pa |
| | | 0 uA/cm$^2$ | 0.14 uA/cm$^2$ | 0.60 uA/cm$^2$ |

The data in Table II described hereinabove shows that the compositions of the present invention consistently provided increased yield stress characteristics while maintaining strong dispersion stability in CTFE. Table IIA shows that neutral, basic, and acidic amino acids all increase yield stress and maintain good dispersion stability in CTFE.

EXAMPLE III

The following samples were prepared and tested for Yield Stess and Current Density. The results of the tests are described in Table III shown hereinbelow. The yield stress and current density of the compositions prepared hereinbelow were tested according to the method described hereinabove.

Sample 8

The composition prepared in this sample was Iron Glycine Chlorohydrate and was prepared in the following manner: 2.68 g of concentrated HCl, 30 g of DI water, and 6.26 g of iron filings were mixed with a stir bar for approximately 2.5 hours and allowed to react. The unreacted iron was then filtered and the remaining solution was concentrated by evaporating the water to about 15 milliliters (ml). Then 2.27 g of glycine was added to the solution and allowed to dissolve. The remaining water was then removed by heating in an oven at about 100° C. The particles were hand ground and dispersed in CTFE at 35 wt % solids. Yield Stress and Current Density values can be seen in Table III. The compound of this sample has the average formula:

$$Fe_1(OH)_yCl_3(glycine)_{3.5}.nH_2O$$

The iron can exist in either ferrous (Fe+2) or ferric (Fe+3) oxidation states dependent on the extent of the oxidation process. Analytical analysis indicates that the majority of of the iron is present in the +2 oxidation state. Due to processing techniques used to isolate the solid particles, excess chloride ions are associated with the complex making it extremely difficult to determine the exact amount of hydroxyl ions.

Sample 9

The composition prepared in this sample was Zinc Glycine Chlorohydrate and was prepared in the following manner: 20.09 g of concentrated HCl, 136 g of DI water, and 40.62 g of zinc metal (dust) were mixed and allowed to react for approximately 24 hours. The unreacted zinc was then filtered and the remaining solution was concentrated by evaporating the water to about 75 milliliters (ml). Then 7.58 g of glycine was added to the solution and allowed to dissolve. The remaining water was then removed by heating in an oven at approximately 70° C. for 8 hours and then in a vacuum oven at 70° C. and 30 torr. for approximately 3 hours. The particles were hand ground and dispersed in CTFE at 35 wt % solids. Yield Stress and Current Density values can be seen in Table III. The compound of this sample has the average formula:

$$Zn_1(OH)_yCl_{2.08}(glycine)_{1.18}.nH_2O$$

The same problem exists with this sample as with sample 8. Excess chloride ions due to deposits of unreacted HCl on the solid particles after processing makes it extremely difficult to determine the exact amount of hydroxyl ion.

Sample 10

The composition prepared in this sample was Zirconium Glycine Chlorohydrate and was prepared in the following manner: 89.6 g of zirconium carbonate paste, 43.8 g of concentrated HCl, and 44.8 g of DI water were mixed and allowed to react. After the reaction was complete, 21.8 g of glycine was added and mixed. The sample was then spray dried and dispersed in CTFE at 35 and 44 wt % solids. Yield Stress and Current Density results can be seen in Table III. The compound of this sample has the average formula:

$$ZrO(OH)_{0.28}Cl_{1.72}(glycine)_{1.10}.nH_2O$$

Sample 11

The composition prepared in this sample was Aluminum Glycine Chlorohydrate and was prepared in the following manner: 8.02 g of 50% aqueous Aluminum Chloride ($AlCl_3$), 144.8 g of aluminum chlorohydrate ($Al_2(OH)_5Cl$) (50% aqueous), 4.28 g of DI water were mixed. An aqueous solution of 14.08 g of glycine was added to the above mixture. The sample was then spray dried and dispersed in CTFE at 35 and 44 wt % solids. Yield Stress and Current Density results can be seen in Table III. The compound of this sample has the average formula:

$$Al(OH)_{2.21}Cl_{0.79}(glycine)_{0.43}.nH_2O$$

Sample 12

The composition prepared in this sample was Aluminum Zirconium Chlorohydrate and was prepared in the following manner: 44.8 g of zirconium carbonate paste, 21.9 g of concentrated HCl, and 22.4 g of DI water were mixed (Part A) and allowed to react. After the reaction was complete, a mixture of 2.8 g of $AlCl_3$ (50% aqueous), 50.5 g of aluminum chlorohydrate ($Al_2(OH)_5Cl$) (50% aqueous), 1.5 g of DI water, and 45.2 g of Part A were mixed. The mixture gelled immediately and was placed in an oven at 40 ° C. to remove the excess water. After drying, the particles were ground using a ball mill, and dispersed in CTFE at 46 wt % solids. Yield Stress and Current Density results can be seen in Table III. The compound of this sample has the average formula:

$$Al_{3.06}Zr(OH)_{9.23}Cl_{3.95}.nH_2O$$

TABLE III

| | YIELD STRESS AND CURRENT DENSITY | | | |
|---|---|---|---|---|
| SAMPLE | 0kV/mm | 1kV/mm | 2kV/mm | 3kV/mm |
| 8 | 120 Pa | 240 Pa | 440 Pa | — |
| | 0 uA/cm$^2$ | <1 nA/cm$^2$ | <1 nA/cm$^2$ | |
| 9 | 144 Pa | 440 Pa | 900 Pa | — |
| | 0 uA/cm$^2$ | 0.78 uA/cm$^2$ | 2.98 uA/cm$^2$ | |
| 10 | 80 Pa | 175 Pa | 700 Pa | 1240 Pa |
| | 0 uA/cm$^2$ | 0.04 uA/cm$^2$ | 0.18 uA/cm$^2$ | 0.5 uA/cm$^2$ |
| 11 | 72 Pa | 470 Pa | 1500 Pa | 2700 Pa |
| | 0 uA/cm$^2$ | 0.04 uA/cm$^2$ | 0.17 uA/cm$^2$ | 0.35 uA/cm$^2$ |
| 12 | 80 Pa | 120 Pa | 280 Pa | 300 Pa |
| | 0 uA/cm$^2$ | 3 uA/cm$^2$ | 14 uA/cm$^2$ | 34 uA/cm$^2$ |

The Examples described hereinabove clearly show the advantages of having an amino acid present in an Electrorheological Fluid. When comparing the ER effects of fluids containing particles with a chemical composition of $[M^p(OH)_y]^q{}_c[A]^r{}_d[B]_z.nH_2O$ with those having the chemical composition of $[M^p(OH)_y]^q{}_c[A]^r{}_d.nH_2O$ it was observed that the composition containing an amino acid ([B]) unexpectedly provided advantageous electrorheological effects. The yield stress values are much higher for the compositions containing an amino acid (B) versus those that do not. This is clearly shown from the information displayed in the Tables described hereinabove. Another advantage of the compositions of this invention which contain an amino acid is that the processing of the particles is much easier when compared to the conventional ER fluids described in the art. When an amino acid is not present in the formulation, a gel forms which must be dried in an oven and mechanically ground. When an amino acid is present in accordance with the present invention the sample remains in solution and spray drying can be utilized to obtain the particles. Spray drying a solution is much less complicated than attempting to dry a gel-like material.

EXAMPLE IV

The following samples were prepared and tested for Yield Stess and Current Density. The results of the tests are described in Table IV shown hereinbelow. The yield stress and current density of the compositions prepared hereinbelow were tested according to the method described hereinabove.

Sample 13

The composition prepared in this sample was Aluminum Zirconium Sarcosine Chlorohydrate and was prepared in the following manner: 9.93 g of zirconium carbonate paste, 4.87 g of concentrated HCl, and 10.05 g of DI water were mixed and allowed to react. After the reaction was complete, 2.81 g of sarcosine (synthetic amino acid) was added. This solution was then added to a mixture of 1.44 g aluminum chloride (50% aqueous), 25.30 g of aluminum chlorohydrate ($Al_2(OH)_5Cl$)(50% aqueous), and 0.74 g DI water. The sample was then dried in a forced air oven at 80° C. for approximately 5 hours. The temperature was then decreased to 50° C. and dried overnight. The sample was then placed in a vacuum oven at 70° C. and 30 torr. for approximately 2.5 hours and then ground by hand, and dispersed in CTFE at 35 wt %. Yield stress and current density results can be seen in Table IV. The compound of this sample has the average formula:

$$Al_{3.5}Zr(OH)_{10.52}Cl_{3.98}(\text{Sarcosine})_{1.11}.nH_2O$$

Sample 14

The composition prepared in this sample was Aluminum Zirconium 6-aminocaproic Acid Chlorohydrate and was prepared in the following manner: 9.61 g of zirconium carbonate paste, 4.61 g of concentrated HCl, and 4.83 g of DI water were mixed and allowed to react. After the reaction was complete, 3.95 g of 6-aminocaproic acid (synthetic amino acid) was added. This solution was then added to a mixture of 1.69 g aluminum chloride (50% aqueous), 25.26 g of aluminum chlorohydrate ($Al_2(OH)_5Cl$)(50% aqueous), and 0.75 g DI water. The sample was then dried in a forced air oven at 80° C. for approximately 5 hours. The temperature was then decreased to 50° C. and dried overnight. The sample was then placed in a vacuum oven at 70° C. and 30 torr. for approximately 2.5 hours and then ground by hand, and dispersed in CTFE at 35 wt %. Yield stress and current density results can be seen in Table IV. The compound of this sample has the average formula:

$$Al_{3.5}Zr(OH)_{11.29}Cl_{3.21}(\text{6-Aminocaproic Acid})_{0.94}.nH_2O$$

Sample 15

The composition prepared in this sample was Aluminum Zirconium DL-2-Aminobutyric Acid Chlorohydrate and was prepared in the following manner: 9.93 g of zirconium carbonate paste, 4.79 g of concentrated HCl, and 4.98 g of DI water were mixed and allowed to react. After the reaction was complete, 3.95 g of DL-2-Aminobutyric Acid (synthetic amino acid) was added. This solution was then added to a mixture of 1.62 g aluminum chloride (50% aqueous), 25.70 g of aluminum chlorohydrate ($Al_2(OH)_5Cl$)(50% aqueous), and 0.80 g DI water. The sample was then dried in a forced air oven at 80° C. for approximately 5 hours. The temperature was then decreased to 50° C. and dried overnight. The sample was then placed in a vacuum oven at 70° C. under full vacuum for approximately 2.5 hours and then ground by hand, and dispersed in CTFE at 35 wt %. Yield stress and current density results can be seen in Table IV. The compound of this sample has the average formula:

$$Al_{3.4}Zr(OH)_{10.43}Cl_{3.77}(\text{DL-2-Aminobutyric Acid})_{1.13}.nH_2O$$

Sample 16

The composition prepared in this sample was Aluminum Zirconium Glycine Chlorohydrate (excess Glycine) and was prepared in the following manner: 5.39 g of zirconium carbonate paste, 2.55 g of concentrated HCl, and 2.55 g of DI water were mixed and allowed to react. After the reaction was complete, 12.46 g of glycine (10 molar excess over Zr) was added. This solution was then added to a mixture of 1.46 g aluminum chloride (50% aqueous), 25.35 g of aluminum chlorohydrate ($Al_2(OH)_5Cl$)(50% aqueous), and 0.79 g DI water. The sample was then dried in a forced air oven overnight at 80° C. The sample was then placed in a vacuum oven at 70° C. and 30 torr. for approximately 3 hours. The particles were then ground by hand and dispersed in CTFE at 35 wt %. Yield stress and current density results can be seen in Table IV. The compound of this sample has the average formula:

$$Al_{6.3}Zr(OH)_{17.26}Cl_{5.64}(\text{Glycine})_{10.39}.nH_2O$$

Sample 17

The composition prepared in this sample was Aluminum Zirconium Oxalic Acid chlorohydrate and was prepared in the following manner: 4.72 g of zirconium carbonate paste, 2.31 g of concentrated HCl, and 2.35 g of DI water were mixed and allowed to react. After the reaction was complete, 1.92 g of Oxalic acid dihydrate (dicarboxylic acid) was added. This solution was then added to a mixture of 0.70 g aluminum chloride (50% aqueous), 12.60 g of aluminum chlorohydrate ($Al_2(OH)_5Cl$)(50% aqueous), and 0.38 g DI water. The sample was then dried in a forced air oven at 110° C. for approximately 1 hour. The temperature was then decreased to 80° C. and dried overnight. The particles were then ground with a ball mill and dispersed in CTFE at 35 wt %. Yield stress and current density results can be seen in Table IV. The compound of this sample has the average formula:

$$Al_{3.8}Zr(OH)_{11.31}Cl_{4.09}(\text{Oxalic acid})_{1.2}.nH_2O$$

Sample 18

The composition prepared in this sample was Aluminum Zirconium Aminofunctional Silicone Hydrolyzate Chlorohydrate. The Aminofunctional Silicone Hydrolyzate is 100 mole % aminofunctional and is a collection of short chain linears and cyclics and has the formula delineated hereinabove on page 23. The composition of this sample was prepared in the following manner: 4.38 g of zirconium carbonate paste, 2.14 g of concentrated HCl, and 2.19 g of DI water were mixed and allowed to react. After the reaction was complete, 2.59 g of Aminofunctional Silicone Hydrolyzate (a diamino compound) was added. At this point the solution gelled, but upon addition of heat (60°–70° C.), the gel turned into a viscous creamy mixture. This solution was then added to a mixture of 0.70 g aluminum chloride (50% aqueous), 12.63 g of aluminum chlorohydrate ($Al_2(OH)_5Cl$)(50% aqueous), and 0.38 g DI water. The sample did gel once again. The sample was then dried in a forced air oven at 105° C. for approximately 1 hour. The temperature was then decreased to 70° C. and dried overnight. The particles were then ground with a ball mill and dispersed in CTFE at 35 wt %. Yield stress and current density results can be seen in Table IV. The compound of this sample has the average formula:

$$Al_4Zr(OH)_{11.45}Cl_{4.55}((CH_3RSiO)_x)_1.nH_2O$$

wherein $R = -CH_2CH(CH_3)CH_2NH(CH_2)_2NH_2$ and wherein x = a number of from 2 to 6.

TABLE IV

| SAMPLE | YIELD STRESS AND CURRENT DENSITY 0kV/mm | 1kV/mm | 2kV/mm |
|---|---|---|---|
| 13 | 96 Pa | 336 Pa | 670–1100 Pa |
| | 0 uA/cm² | 21.5 uA/cm² | 71.6 uA/cm² |
| 14 | 80 Pa | 430 Pa | 580 Pa |
| | 0 uA/cm² | 19.5 uA/cm² | 63.6 uA/cm² |
| 15 | 88 Pa | 336 Pa | 740 Pa |
| | 0 uA/cm² | 6.0 uA/cm² | 25.8 uA/cm² |
| 16 | 160 Pa | 425 Pa | 750 Pa |
| | 0 uA/cm² | 0.003 uA/cm² | 0.02 uA/cm² |
| 17 | 112 Pa | 350 Pa | 900–1000 Pa |
| | 0 uA/cm² | 0.99 uA/cm² | 4.17 uA/cm² |
| 18 | 130 Pa | 460 Pa | 900–1500 Pa |
| | 0 uA/cm² | 0.64 uA/cm² | 1.2 uA/cm² |

The data in Table IV clearly shows that synthetic amino acids also contribute to enhanced yield stress for the electroheological compositions of the present invention. The data described in the Tables presented hereinabove show that the compositions of the present invention unexpectedly and consistently provided beneficial electrorheological properties while maintaining strong dispersion stability. The data in Table IV also shows that other ligands also function in the compositions of the present invention such as ligands containing COOH, $NH_2$ or silicone functional materials. Thus the present invention is not limited to only an amino acid ligand.

It should be apparent from the foregoing that many other variations and modifications may be made in the compounds, compositions and methods described herein without departing substantially from the essential features and concepts of the present invention. Accordingly it should be clearly understood that the forms of the invention described herein are exemplary only and are not intended as limitations on the scope of the present invention as defined in the appended claims.

That which is claimed is:

1. An electrorheological fluid composition comprising (i) an electrically non-conducting liquid selected from the group consisting of polychlorinated biphenyl, fluorocarbon oil, chlorotrifluoroethylene, and polymethyltrifluoropropylsiloxane; and (ii) a compound having the general formula:

$$[(M)^p(H_2O)_x(OH)_y]^q{}_c[A]^r{}_d.B_z.nH_2O$$

wherein M is a metal cation or a mixture of metal cations at various ratios; p is the total valence of M and has a value of greater than zero; x is zero or has a value greater than zero, y is zero or has a value greater than zero, with the proviso that only one of x or y can be zero at any given time; q has a value of p minus y with the proviso that q has a value of at least one; c has a value of greater than zero; A is an anion or a mixture of anions at various ratios; r is the total valence of A with the proviso that r has a value of at least one; d has a value of greater than zero with the proviso that (q×c) is always equal to (r×d); B is an amino acid or a mixture of amino acids; z has a value of from 0.01 to 100; and n is a number from 0 to 15.

2. An electrorheological fluid composition according to claim 1, wherein M is selected from the group consisting of alkaline earth metals, transition metals, lanthanides, Group 13 elements, Group 14 elements, and Group 15 elements.

3. An electrorheological fluid composition according to claim 1, wherein M is selected from the group consisting of aluminum, zirconium, iron, and zinc.

4. An electrorheological fluid composition according to claim 1, wherein A is a halide.

5. An electrorheological fluid composition according to claim 4, wherein the halide is selected from the group consisting of chloride, bromide, and iodide.

6. An electrorheological fluid composition according to claim 1, wherein A is selected from the group consisting of sulfate and phosphate.

7. An electrorheological fluid composition according to claim 1, wherein B is selected from the group consisting of essential amino acids, nonessential amino acids, and synthetic amino acids.

8. An electrorheological fluid composition according to claim 7, wherein the essential amino acid is selected from the group consisting of isoleucine, phenylalanine, leucine, lysine, methionine, threonine, tryptophan, and valine.

9. An electrorheological fluid composition according to claim 7 wherein the non-essential amino acid is selected from the group consisting of alanine, glycine, arginine, histidine, proline, and glutamic acid.

10. An electrorheological fluid composition according to claim 7, wherein the synthetic amino acid is selected from the group consisting of Sarcosine, 6-aminocaproic Acid, and DL-2-Aminobutryic Acid.

11. An electrorheological fluid composition according to claim 1, wherein:

(a) M is a mixture of aluminum and zirconium;

(b) x is equal to zero;
(c) y is a number from 0.1 to 15;
(d) A is chloride;
(e) d is a number from 0.1 to 5;
(e) B is proline;
(f) z is a number from 0.1 to 5; and
(g) n is a number from 0.1 to 10.

* * * * *